US008333459B2

(12) United States Patent
Rivas et al.

(10) Patent No.: US 8,333,459 B2
(45) Date of Patent: Dec. 18, 2012

(54) PRINTING DEVICE

(75) Inventors: Rio Rivas, Corvallis, OR (US); Jon A. Crabtree, San Diego, CA (US); Eric L. Nikkel, Philomath, OR (US); Siddhartha Bhowmik, Salem, OR (US); Bradley D. Chung, Corvallis, OR (US); Samson Berhane, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

(21) Appl. No.: 12/933,218

(22) PCT Filed: Apr. 29, 2008

(86) PCT No.: PCT/US2008/005663

§ 371 (c)(1),
(2), (4) Date: Sep. 17, 2010

(87) PCT Pub. No.: WO2009/134225

PCT Pub. Date: Nov. 5, 2009

(65) Prior Publication Data

US 2011/0018938 A1 Jan. 27, 2011

(51) Int. Cl.
*B41J 2/135* (2006.01)

(52) U.S. Cl. ..... 347/45; 216/17; 216/27; 239/288; 347/63; 427/240; 427/534; 427/569; 428/342

(58) Field of Classification Search ..... None
See application file for complete search history.

(56) References Cited

U.S. PATENT DOCUMENTS

| | | | | |
|---|---|---|---|---|
| 4,007,352 | A | 2/1976 | Ura | |
| 5,057,856 | A | 10/1991 | Takagi | |
| 5,187,499 | A | 2/1993 | Murakami | |
| 6,217,155 | B1 * | 4/2001 | Silverbrook | 347/56 |
| 6,758,552 | B1 | 7/2004 | Figueredo | |
| 6,846,068 | B2 | 1/2005 | Kim | |
| 2004/0035823 | A1 | 2/2004 | Min et al. | |
| 2005/0078143 | A1 | 4/2005 | Shimomura | |
| 2006/0055744 | A1 | 3/2006 | Tanaka | |
| 2006/0256162 | A1 | 11/2006 | Hayakawa | |
| 2007/0252873 | A1 | 11/2007 | Saito | |

FOREIGN PATENT DOCUMENTS

| | | |
|---|---|---|
| EP | 1366906 | 12/2003 |
| KR | 1020000026006 | 5/2000 |

OTHER PUBLICATIONS

Supplementary European Search Report for Application No. EP08767501.3 Report issued Mar. 29, 2011.

* cited by examiner

*Primary Examiner* — Matthew Luu
*Assistant Examiner* — John P Zimmermann

(57) ABSTRACT

A printing device (10) including a substrate (22) having an aperture (20) extending therethrough, wherein the aperture includes a side wall and defines a liquid ink flow path, an ink firing chamber (24) fluidically connected to the aperture, and a coating positioned on the side wall of the aperture, the coating being impervious to etching by liquid ink, and wherein the coating is chosen from one of silicon dioxide, aluminum oxide, hafnium oxide and silicon nitride.

20 Claims, 2 Drawing Sheets

PRINTING DEVICE

BACKGROUND

Printing devices, such as liquid jet printers, may feed liquid ink through a substrate to a firing port. While the liquid ink is fed through the substrate, such as through a channel that extends through the substrate, the liquid ink will come into contact with the channel walls. In an example wherein the substrate is manufactured of silicon and the liquid ink is a pigmented ink including charged dispersants, the liquid ink may etch the channel wall of the substrate such that silicon leaches into the pigmented ink. The presence of silicon in the ink may cause a blockage or partial blockage of the firing port. It may be desirable to reduce such blockage or partial blockage of the firing port to improve the print quality of the printing device.

DETAILED DESCRIPTION OF THE DRAWINGS

Figure 1:
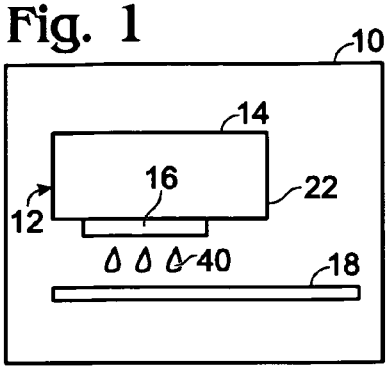
FIG. 1 is a schematic side cross-sectional view of one example embodiment of a printing device including one example embodiment of a coated substrate channel.

FIG. 1 is a schematic side cross-sectional view of one example embodiment of a printing device 10 including one example embodiment of a coated substrate channel 12. Printing device 10 may be any type of printing device, but in the embodiment shown, is a thermal ink jet printer including a printhead 14 made from substrate 22 having a nozzle plate 16 for printing an image on a media 18, such as on a sheet of paper. Printhead 14 may include multiple apertures 20 (one aperture 20 shown in FIGS. 2 and 3) formed through a substrate 22 wherein each aperture 20 is connected to a firing chamber 24 (FIGS. 2 and 3), as will be described with respect to FIGS. 2 and 3.

Figure 2:
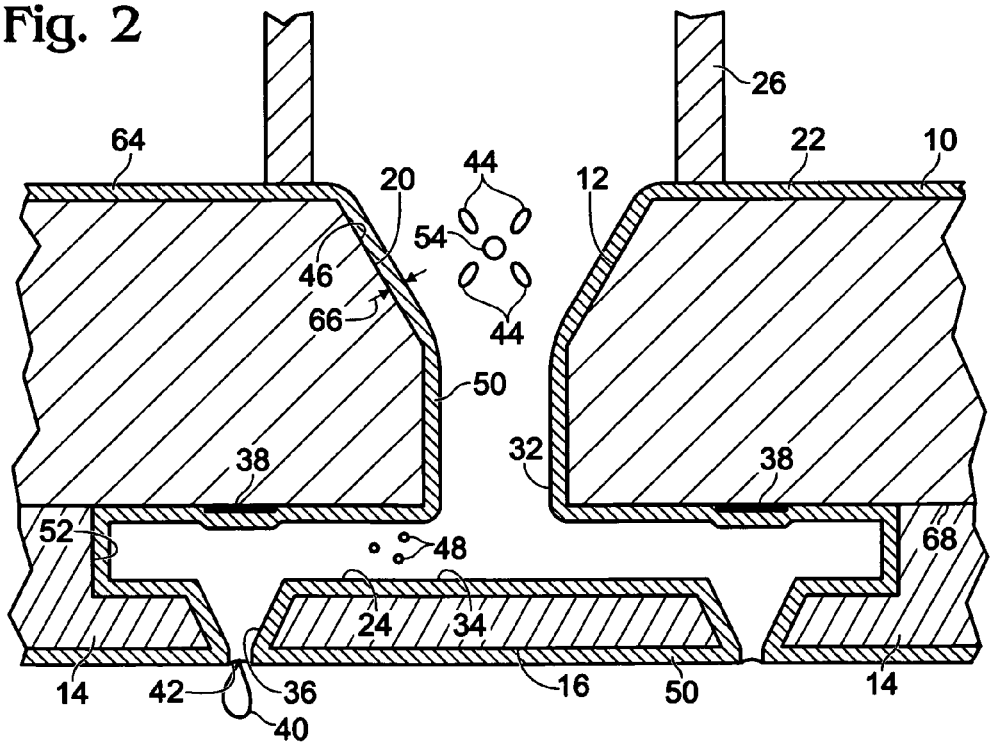
FIG. 2 is a schematic detailed side cross-sectional view of one example embodiment of a coated substrate channel.
Figure 3:
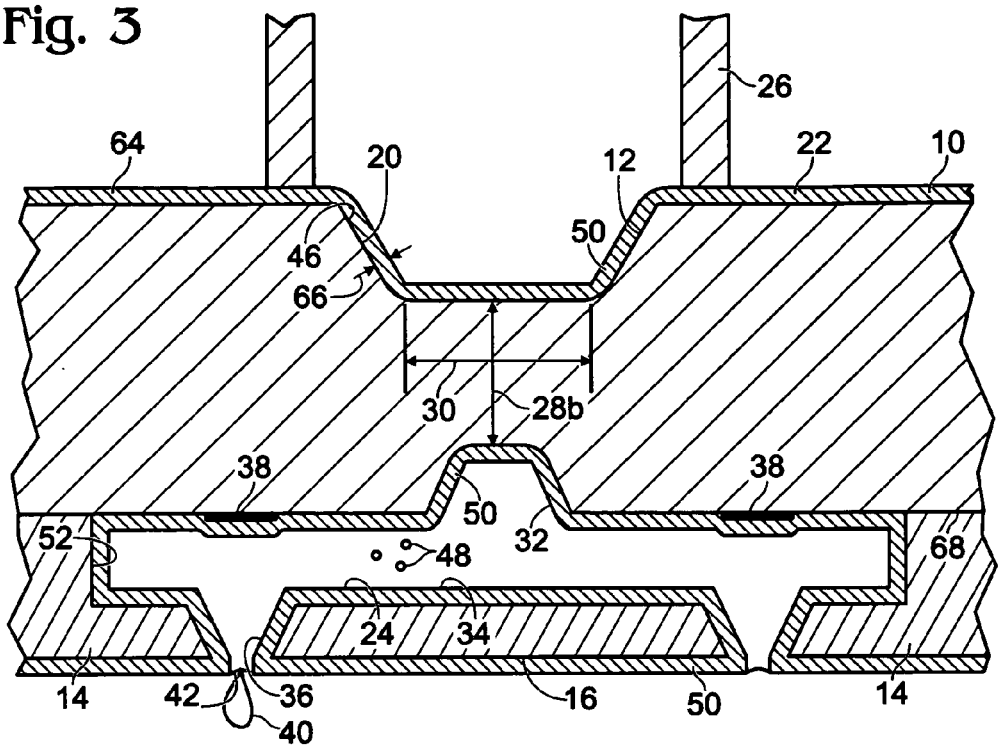
FIG. 3 is a schematic detailed side cross-sectional view of one example embodiment of a coated substrate channel include a strengthening structure therein.

FIG. 2 is a schematic detailed side cross-sectional view of one example embodiment of the coated substrate channel 12 formed through substrate 22. In particular, substrate 22 may include multiple apertures 20 (one of which is shown for ease of illustration) formed through a substrate 22 wherein each aperture 20 is connected to a firing chamber 24 formed on substrate 22. An ink supply chamber (not shown) may be fluidically connected to aperture 20 by a supply structure 26. Supply structure may be tube connected to a supply chamber, for example, or supply structure 26 may be fluidic manifold that is attached to the printhead. Fluidic manifold 26 may be plastic that is injected molded, fabricated from plastic, or fabricated from ceramic, for example. Aperture 20 may include a strengthening structure 28, such as a rib or cross bar, that may extend across an expanse 30 of aperture 20 so as to strengthen aperture 20 within substrate 22.

Strengthening structures 28 may be referred to as ribs and may be formed in a variety of shapes and sizes. In one example embodiment, structures 28 may be recessed from the front side 68 and the backside 64 of substrate 22. The structures 28 may have a width 28*a* (FIG. 3) in a range of approximately 30 to 300 microns and a depth 28*b* (FIG. 2) in a range of approximately 100 microns to the full thickness of substrate 22. The open length 28*c* (FIG. 3) between structures 28 may vary in a range of 100 microns to over 1,000 microns, for example. The purpose of strengthening structures 28 is to increase the die strength so that long and narrow apertures 20 may be fabricated in substrates 22 with a high yield. In one example embodiment, the total effective aperture 20, or slot, length 20*a* (FIG. 3) may range from one half inch (12,700 microns) to 1.5 inches (38,100 microns), for example. The coating process of the present invention provides for coating of narrow apertures 20, and of apertures 20 including strengthening structures 28, such that the substrate material of which the substrate 22 and the structures 28 are formed is not etched by contact with ink 42.

In one example embodiment, substrate 22 is formed from a starting substrate of a [100] silicon wafer that may be 150 or 200 millimeters (mm) in diameter and 675 or 725 micrometers (um) in thickness. The starting silicon wafer may have a concentration of 10^14 to 10^19 atoms/cm3 of impurities such as boron, phosphorous, arsenic, or antimony, for desirable device performance. The starting silicon wafer may also have a low level of interstitial oxygen.

Still referring to FIG. 2, firing chamber 24 may be formed on substrate 22 at an exit aperture 32 of substrate aperture 20. The firing chamber 24 may define a firing channel 34 that terminates in a firing orifice 36 positioned opposite a thermal firing resistor 38, for example. Firing chamber 24 may be manufactured on substrate 22, and may be manufactured of a photo imagable epoxy, for example. Firing resistor 38 may be connected to a power source (not shown) and a controller (not shown) such that firing resistor 38 may be activated upon demand to cause ejection of an ink droplet 40 of ink 42 from firing orifice 36.

Ink 42 may be contained in an ink supply (not shown) and may be flowed through supply structure 26, through aperture 20 in substrate 22, through firing channel 34 of firing chamber 24, and out of firing orifice 36 to print an image on a sheet of print media 18 (FIG. 1), such as on a sheet of paper, for example. In one embodiment ink 42 may be a pigmented ink including charged dispersants 44 and pigment particles 54 therein, wherein the charged dispersants 44 support the pigments of the ink. The use of a pigmented ink 42, instead of a dye based ink, is that pigmented inks may have a greater color gamut, high fade resistance, better water-fastness, shorter dry time, and great media compatibility when compared to dye based inks.

Charged dispersants 44 in a pigmented ink 42 or high pH solvent may etch a silicon material, such as an exposed wall 46 of aperture 20 of silicon substrate 22, which may result in silicon particles 48 leaching into ink 42. The presence of silicon particles 48 in ink 42, above a known part per million (ppm) threshold, such as above ten (10) ppm, may result in the precipitation of silicon at firing orifice 36, so that the firing orifice 36 may become blocked or partially blocked, thereby reducing the accuracy and printing capability of nozzle plate 16 of printing device 10.

The printing device 10 of the present invention, therefore, includes a protective coating 50 formed on exposed walls 46 of apertures 20 of substrate 22 so that the silicon material of substrate 22 is out of contact of ink 42. Protective coating 50 may also completely coat the backside 64 of substrate 22. Protective coating 50 may also completely coat strengthening structures 28, and interior wall surfaces 52 of firing chamber 24. Protective coating 50 may also coat the interior surface of supply structure 26, such as a fluidic manifold. Protective coating 50 may be formed of an ink impervious material such as silicon dioxide (SiO2), silicon nitride (Si3N4), aluminum oxide (Al2O3), hafnium oxide (HaO2), a conformal polymer formed from a gas phase monomer such as polyxylene, an organic polymer, a plated metal such as nickel, gold or palladium, and other materials such as silicon carbide, or any other ink impervious material or combination of materials. The ink impervious coating 50 will prevent, or will substantially reduce, etching of the silicon substrate 22 material by ink 42 such that silicon particles 48 are not (or a very low number are) present in ink 42 so that firing orifices 36 do not become blocked or partially blocked by silicon precipitation at firing orifices 36.

Figure 4:
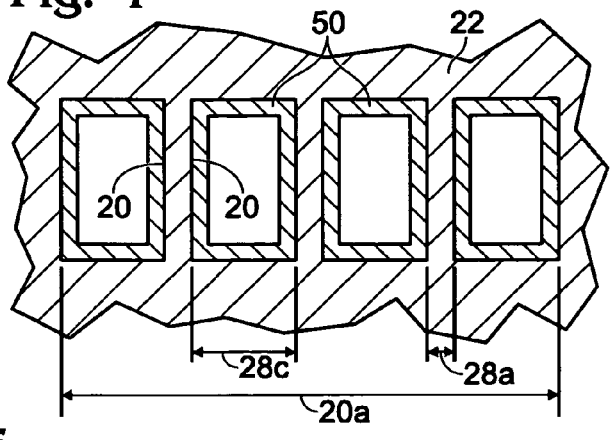
FIG. 4 is a schematic detailed top view of one example embodiment of a coated substrate channel including several strengthening structures.

FIG. 4 is a schematic detailed backside view (relative to firing orifice 36) of one example embodiment of a coated substrate channel 20, such as an elongate slot, including several strengthening structures 28 extending thereacross. Channel 20, and each of strengthening structures 28 includes protective coating 50 thereon. Formation of protective coating 50 will now be described with respect to FIG. 5.

Figure 5:
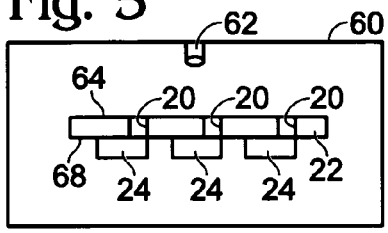
FIG. 5 is a schematic cross-sectional side view of one example embodiment of a deposition chamber for coating one example embodiment of a substrate channel.

FIG. 5 is a schematic cross-sectional side view of one example embodiment of a deposition chamber 60 for coating a silicon dioxide coating 50, for example, on the exposed walls 46 of substrate apertures 20. In the example embodiment, the process utilized is plasma enhanced chemical vapor deposition (PECVD). The deposition occurs in a Centura (R) DXZ chamber at a pressure of approximately 8 torr, at a temperature of approximately 170 degrees Celsius (the photo imageable epoxy glass transition temperature), and at a power of approximately 1,000 Watts. The gases fed through one or more gas inlet ports 62 are oxygen (O2) at 980 standard cubic centimeters per minute (sccm), Helium (He) at 1,000 sccm, and tetra ethyl ortho silicate (TEOS) at 1,000 sccm. Substrate 22 may be positioned so that a backside 64 of the substrate 22 faces gas inlet port 62 such that coating 50 is formed from the supply structure 26 side of substrate 22. In this example embodiment, a coating 50 having a thickness 66 (FIG. 2) of approximately 20,000 Angstroms is deposited in approximately ninety (90) seconds from backside 64 of substrate 22 such that strengthening structure 28 and exposed wall 46 of apertures 20 are coated with coating 50. In another embodiment, substrate 22 may be positioned so that a front side 68 of the substrate 22 faces gas inlet port 62 such that coating 50 is formed from the firing chamber 24 side of substrate 22. In such an example embodiment, a coating 50 having a thickness 66 (FIG. 2) of approximately 20,000 Angstroms is deposited in approximately ninety (90) seconds from front side 68 of substrate 22 such that interior walls 52 of firing chamber 24, exposed wall 46 of apertures 20, and then strengthening structures 28 are coated with coating 50. In another example embodiment, coating 50 may be applied to substrate 22 from both a backside 64 deposition process and a front side 68 deposition process. The chemical reaction of the this example process wherein coating 50 formed is silicon dioxide is given as: Si(OC2H5)->SiO2+byproducts.

This example process as described immediately above allows for low temperature deposition of protective coating 50 over the substrate 22 and over the interior walls 52 of the firing chamber 34, which may be manufactured of photo imagable epoxy. In the example embodiment mentioned above, where the application is performed from both the backside 64 and the front side 68, coating 50 may encapsulate the firing chamber 35 entirely, preventing chemical attack from the ink. The deposition temperature of chamber 60 may be maintained at 170 degrees Celsius or less so that the photo imagable epoxy material is not damaged.

The following processes may be utilized to form protective coatings 50: plasma enhanced chemical vapor deposition (PECVD) of silicon dioxide; atomic layer deposition (ALD) of aluminum oxide; atomic layer deposition of hafnium oxide; inductively coupled plasma chemical vapor deposition (ICP CVD) of silicon dioxide; inductively coupled plasma chemical vapor deposition (ICP CVD) of silicon nitride; microwave plasma assisted chemical vapor deposition (CVD) of silicon dioxide; chemical vapor deposition of a conformal polymer formed from a gas phase monomer (such as polyxylene); deposition of an organic polymer with a plasma assist process; and electro less plating of a metal (such as nickel); and electroplating a metal (such as nickel, gold or palladium). The following high temperature coating processes can be used on print head architectures that are fabricated from materials that do not degrade at high temperatures. For example, the firing chamber may be fabricated from an electroplated metal, a silicon oxide or a polyimide: plasma enhanced chemical vapor deposition (PECVD) of silicon carbide; and plasma enhanced chemical vapor deposition (PECVD) of silicon nitride. Each of these processes may be utilized to form coating 50 in apertures 20 of substrate 22 of a printhead formed in many different configurations. For example, the printhead may have a nozzle plate made from an electroformed metal, a photo imageable polymer, a polyimide, or a polymer nozzle plate where the nozzles are formed by laser ablation. The apertures 20, or slots, in substrate 22 may be formed by techniques such as wet etch, reactive ion etch, abrasion jet machining, laser ablation, and a combination of these techniques.

In another example process, a sacrificial resist may be applied to areas where coating 50 is not be applied, such as to bond pads, for example. After deposition of coating 50, the sacrificial resist may be removed by a liftoff process to provide the finished device 10.

Coating 50 of the present invention may reduce etching of silicon from substrate 22 into ink 42 such that the part per million (ppm) content of silicon in an ink 42 may be reduced, such as to less than 10 ppm, and approximately 5 ppm silicon, for example, which may reduce or eliminate the formation of silicate rings at firing orifice 36. Substrate 22 and aperture 20 without coating 50 have been determined to have a much higher silicon ppm content, such as approximately 23 ppm silicon. Testing to determine the above listed outcomes was performed wherein a substrate was submersed in 10 ml of ink 42 for two days at 70 degrees Celsius. The sawn edges of the substrate were coated with a silicon epoxy to prevent etching of the die edge. The ink sample in both cases (the coating substrate and the uncoated substrate) were then evaluated for silicon concentration using inductively coupled plasma spectrometry (ICP) analysis. It is noted that silicon epoxy, which was utilized to seal the die edges, typically yields a silicon content of 3.5 ppm. Accordingly, the coated substrate 22 and aperture 20, which was measured to produce an ink 42 having a silicon content of 5 ppm, may have contributed only 1.5 ppm of silicon from the coated substrate. In contrast, the uncoated substrate 22 and aperture 20 which was measured to produce an ink 42 having a silicon content of 23 ppm, may have contributed as much as 19.5 ppm of silicon from the coated substrate 22 and aperture 20, well above the threshold of 10 ppm which may be though to produce silicate rings at firing orifices 36.

In another ink soak test, coated and uncoated substrate 22 and aperture 20 were assembled in pens, filled with ink 42, and stored for seven days at 60 degrees Celsius. Subsequently a small sample of ink was expelled through the nozzles and evaluated for silicon concentration using ICP analysis. The pens with coated substrate 22 and aperture 20 were measured to produce an ink 42 having a silicon concentration of 7.4 ppm. In contrast, pens with uncoated substrate 22 and aperture 20 were measured to produce an ink 42 having a silicon concentration of 53 ppm, well above the threshold of 10 ppm which may be thought to produce silicate rings at firing orifices 36.

In both test samples, ink 42 was fired through firing orifice 36 including both the coated and uncoated substrate 22 and it was found that print reliability and directionality was not compromised by inclusion of coating 50.

The process of applying protective coating 50, as described herein, allows the use of corrosive inks with readily formable and patternable substrates, such as silicon. Accordingly, use of coating 50 on readily available substrates may reduce the use of highly robust substrates, such as stainless steel substrates, that may not be readily formable or patternable using known technologies. Accordingly, the use of protective coating 50 increases the class of inks with which well known substrates, such as silicon, may be utilized, without encountering silicon precipitation or leaching into the inks 42.

In other embodiments, other substrates may be utilized such as glass, for example.

Other variations and modifications of the concepts described herein may be utilized and fall within the scope of the claims below.

We claim:

1. A printing device (10), comprising:

a substrate (22) including an aperture (20) extending therethrough that defines a slot formed into said substrate and wherein said slot includes a mechanical strengthening structure (28) extending across an expanse of said aperture, wherein said aperture includes a side wall (46) and defines a liquid ink flow path;

an ink firing chamber (24) including interior wall surfaces (52) that define a firing channel (34) that terminates in a firing orifice (36) fluidically connected to said aperture; and a coating (50) positioned on said side wall of said aperture and positioned on all of said interior wall surfaces of said firing channel, said coating being impervious to etching by liquid ink (42), and wherein said coating is chosen from one of silicon dioxide, aluminum oxide, hafnium oxide, silicon nitride, a conformal polymer formed from a gas phase monomer, an organic polymer, a plated metal chosen from one of nickel, gold and palladium, silicon carbide, and a combination thereof.

2. The device (10) of claim 1 wherein said substrate (22) is manufactured of silicon.

3. The device (10) of claim 1 wherein said coating (50) is impervious to etching by a pigmented ink including charged dispersants (44) therein.

4. The device (10) of claim 1 wherein said aperture (20) defines a slot formed into said substrate and wherein said slot includes a mechanical strengthening structure (28) extending across an expanse of said aperture.

5. The device (10) of claim 1 wherein an entirety of a surface of said aperture is coated with said coating.

6. The device (10) of claim 1 wherein said coating (50) reduces substrate material from dissolving into an ink such that an ink retained in said aperture for at least two days at a temperature of 70 degrees Celsius and at atmospheric pressure, includes less than 10 ppm of substrate material dissolved therein.

7. The device (10) of claim 1 wherein said ink firing chamber (24) is manufactured of photoimageable epoxy and includes a thermal resistor (38), and wherein an exterior surface of said firing chamber includes said coating (50) positioned thereon.

8. The device (10) of claim 1 wherein said coating (50) is further positioned on at least an interior of an ink supply structure (26) connected to said aperture.

9. A method of making a printing device (10), comprising:

forming an aperture (20) that extends through a substrate (22) and defines a slot formed into said substrate and wherein said slot includes a mechanical strengthening structure (28) extending across an expanse of said aperture, wherein said aperture defines an exposed surface;

forming an ink ejection nozzle (36) in fluidic connection with said aperture; and coating said exposed surface of said aperture, with an ink impervious coating material (50), and wherein said coating is chosen from one of silicon dioxide, aluminum oxide, hafnium oxide, silicon nitride, a conformal polymer formed from a gas phase monomer, an organic polymer, a plated metal chosen from one of nickel, gold and palladium, silicon carbide, and a combination thereof.

10. The method of claim 9 wherein an interior of said ink ejection nozzle defines a nozzle exposed surface (52), said method further comprising coating said nozzle exposed surface with an ink impervious nozzle coating material (50), and wherein said nozzle coating material is chosen from one of silicon dioxide, aluminum oxide, hafnium oxide and silicon nitride.

11. The method of claim 9 wherein said coating (50) is coated on said exposed surface by one of chemical vapor deposition (CVD), plasma enhanced chemical vapor deposition, atomic layer deposition (ALD), inductively coupled plasma chemical vapor deposition, and microwave plasma assisted chemical vapor deposition.

12. The method of claim 9 wherein said substrate (22) is manufactured of silicon.

13. The method of claim 9 wherein said coating (50) is coated on said exposed surface from at least one of a front side (68) of said substrate and a backside (64) of said substrate.

14. The method of claim 9 wherein said coating (50) is fabricated using tetraethylorthosilicate (TEOS) as a starting deposition material.

15. The method of claim 9 wherein said coating (50) defines a thickness in a range of 0.1 to 5.0 micrometers.

16. The method of claim 9 wherein said ink impervious coating material (50) is impervious to pigmented ink including charged dispersants therein.

17. The method of claim 9 wherein said substrate (22) is manufactured of silicon and wherein said coating is coated on said exposed surface at a temperature below 170 degrees Celsius.

18. A method of printing, comprising:

flowing an ink (42) through an aperture (20) that extends through a silicon containing substrate (22) and defines a slot formed into said substrate and wherein said slot includes a mechanical strengthening structure (28) extending across an expanse of said aperture, said aperture including a coating (50) on a sidewall thereof, said coating being impervious to etching by said ink, and wherein said coating is chosen from one of silicon dioxide, aluminum oxide, hafnium oxide, silicon nitride, a conformal polymer formed from a gas phase monomer, an organic polymer, a plated metal chosen from one of nickel, gold and palladium, silicon carbide, and a combination thereof;

flowing said ink from said aperture to a firing chamber (24); and firing ink from said firing chamber.

19. The method of claim 18 further comprising holding said ink (42) in said aperture between a first firing of ink from said firing chamber and a second firing of ink from said firing chamber, wherein said ink held in said aperture between said first and said second firing of ink from said firing chamber does not etch said coating (50).

20. The method of claim 18 wherein said coating (50) is coated on said sidewall by one of chemical vapor deposition (CVD), plasma enhanced chemical vapor deposition, atomic layer deposition (ALD), inductively coupled plasma chemical vapor deposition, and microwave plasma assisted chemical vapor deposition.

* * * * *